US006893386B2

(12) United States Patent
Charoenchit

(10) Patent No.: US 6,893,386 B2
(45) Date of Patent: May 17, 2005

(54) PHYSICAL THERAPY CHAIR-BED FOR PARALYTIC PATIENTS

(76) Inventor: Chakri Charoenchit, 6/77 Moo 5 Boromrajchonnee Road, Bangkok 10170 (TH)

( * ) Notice: Subject to any disclaimer, the term of this patent is extended or adjusted under 35 U.S.C. 154(b) by 330 days.

(21) Appl. No.: 10/161,977

(22) Filed: Jun. 4, 2002

(65) Prior Publication Data

US 2003/0224915 A1 Dec. 4, 2003

(51) Int. Cl.[7] ..... A63B 26/00

(52) U.S. Cl. ..... 482/142; 482/148; 297/15; 297/115; 297/116; 297/118; 5/2.1; 5/600; 601/23; 601/24; 601/26

(58) Field of Search ..... 482/142, 52, 123, 482/92, 126, 129–30, 94, 121, 148; 297/14, 115, 116, 118, 83.1; 5/2.1, 600

(56) References Cited

U.S. PATENT DOCUMENTS 4,402,096 A * 9/1983 Atimichuk ..... 5/17
4,506,927 A * 3/1985 Lombardo ..... 297/118
4,936,554 A * 6/1990 Heyward ..... 267/64.16
5,342,114 A * 8/1994 Burke et al. ..... 297/344.2
5,398,357 A * 3/1995 Foster ..... 5/619
5,402,544 A * 4/1995 Crawford et al. ..... 5/616
5,703,922 A * 12/1997 Rattner ..... 378/65
5,820,519 A 10/1998 Slenker
5,820,532 A 10/1998 Oliver
6,151,738 A * 11/2000 Arr ..... 5/661
6,163,903 A * 12/2000 Weismiller et al. ..... 5/610
6,381,781 B1 * 5/2002 Bourgraf et al. ..... 5/618
6,484,334 B1 * 11/2002 Borders et al. ..... 5/600
6,685,658 B1 * 2/2004 Dietz et al. ..... 601/5

* cited by examiner

*Primary Examiner*—Justine R. Yu
*Assistant Examiner*—L. Amerson
(74) *Attorney, Agent, or Firm*—Desukanya Jesadanont

(57) ABSTRACT

A physical therapy chair-bed is a patient bed consisting of three parts, the first, the second and the third parts. The first can also be used as backrest of a physical therapy chair with its flanking parts arranged as armrests. The second part can also form a seat. The third part can be kept inside a case underneath the first and the second parts. All the other components are kept inside the case. There are wheels and wheel-locks mounted under the case at each corner. The chair-bed is equipped with a foot-leg exercise set having a footwear set to help the seat occupant exercise his feet and legs in a bicycling manner. The armrests can move to have the patient's arms exercise. Rack guards and footrests are provided. The chair-bed can be mechanically or electrically and electronically controlled where a remote control may be applied.

1 Claim, 15 Drawing Sheets

PHYSICAL THERAPY CHAIR-BED FOR PARALYTIC PATIENTS

FIELD OF THE INVENTION

This invention is designed to help paralyzed patients or partially paralyzed patients developing or maintaining the muscle tone of their arms and legs, in addition to preventing joint stiffness.

PRIOR ART

There are a lot of exercise machines using variable resistance mechanisms such as fluid types which use the viscosity of fluid and a turbine to create resistance and friction. Some machines use magnets in close proximity to a piece of metal. Many exercise machines are mostly designed for users who is standing or sitting or stay beside the machines, for example, U.S. Pat. No. 5,820,532. Only large stationary overhead beams and levers are used which is not sufficient for bedridden patients to permit bending and flexing of the knees and elbows. U.S. Pat. No. 5,820,519 has combined a 'nordic type' exercise with a feature of adjustable rope mechanisms in small increments by means of the special handles and stirrups to apply the drum friction type resistance machine. Yet the machine still is too hard for those paralytic or partially paralytic patients to do the exercise to maintain their muscle tone. The present invention describes a machine using electrical and mechanical system to help paralytic or unconscious patients who can not perform a normal exercise on their own to move gently the parts of their body and improve their blood circulation, in addition to maintain or improve their muscle tone of their extremities.

SUMMARY OF THE INVENTION

A physical therapy chair-bed consists of three parts, the first, the second and the third parts. The first can either lie flat and be used as part of a patient bed or be held up and used as backrest of a physical therapy chair with its flanking parts on the left and right side arranged as armrests. The second part forms a middle part of a patient bed or a seat of the physical therapy chair. The third part forms the other end of the patient bed which can be slid to be kept in a case underneath the first and the second parts. All the other components except the first and the second parts of the bed are kept inside the case. There mounted under the case at each corner a wheel to assist moving where wheel-lock may be installed to fix the case in place when in use. The chair-bed is further equipped with a foot-leg exercise set comprising a motor to drive a shaft to rotate a footwear set that helps the seat occupant wearing the footwear exercise his feet and legs in a bicycling manner where the level of footwear can be adjusted for each individual. The armrests can move to have the patient arms exercise to prevent stiff-joint. Rack guards and footrests are also provided. The chair-bed can be mechanically or electrically and electronically controlled where a remote control system may also be applied.

DETAILED DESCRIPTION OF PREFERRED EMBODIMENTS

Figure 1:
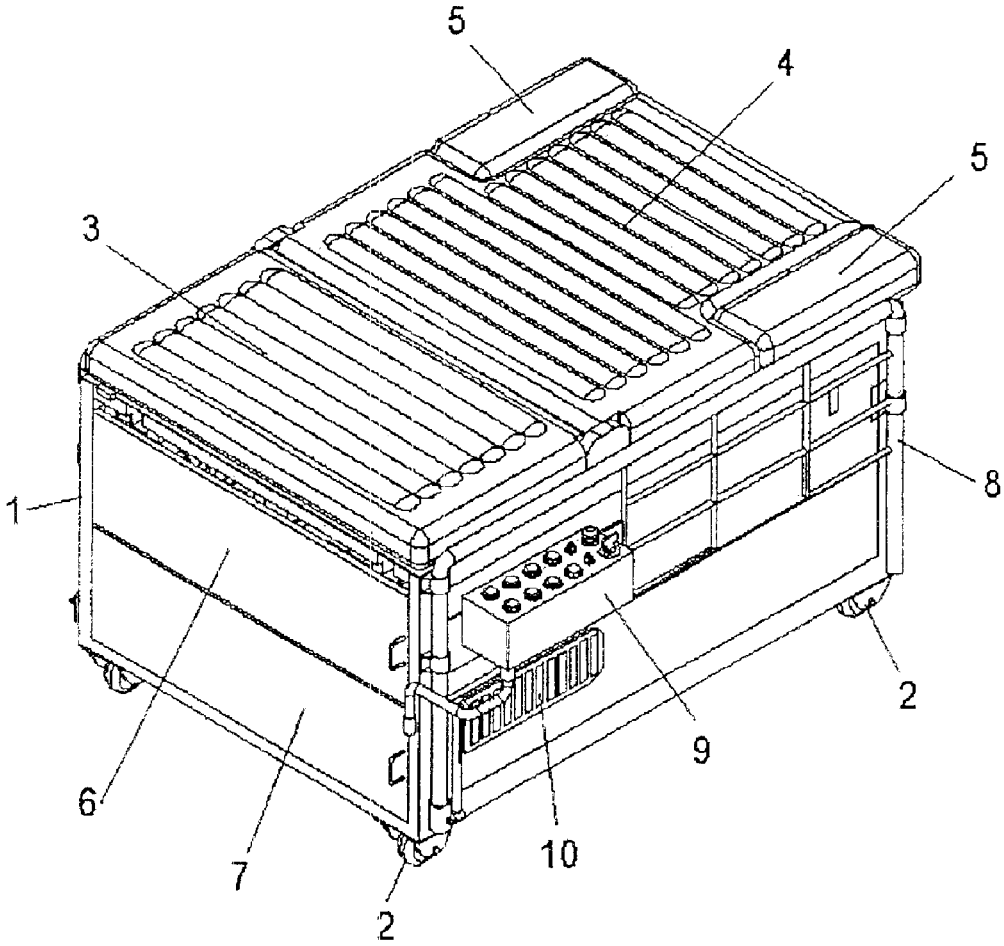
FIG. 1 shows an isometric view of the physical therapy chair-bed in a wrapped-up position.
Figure 2:
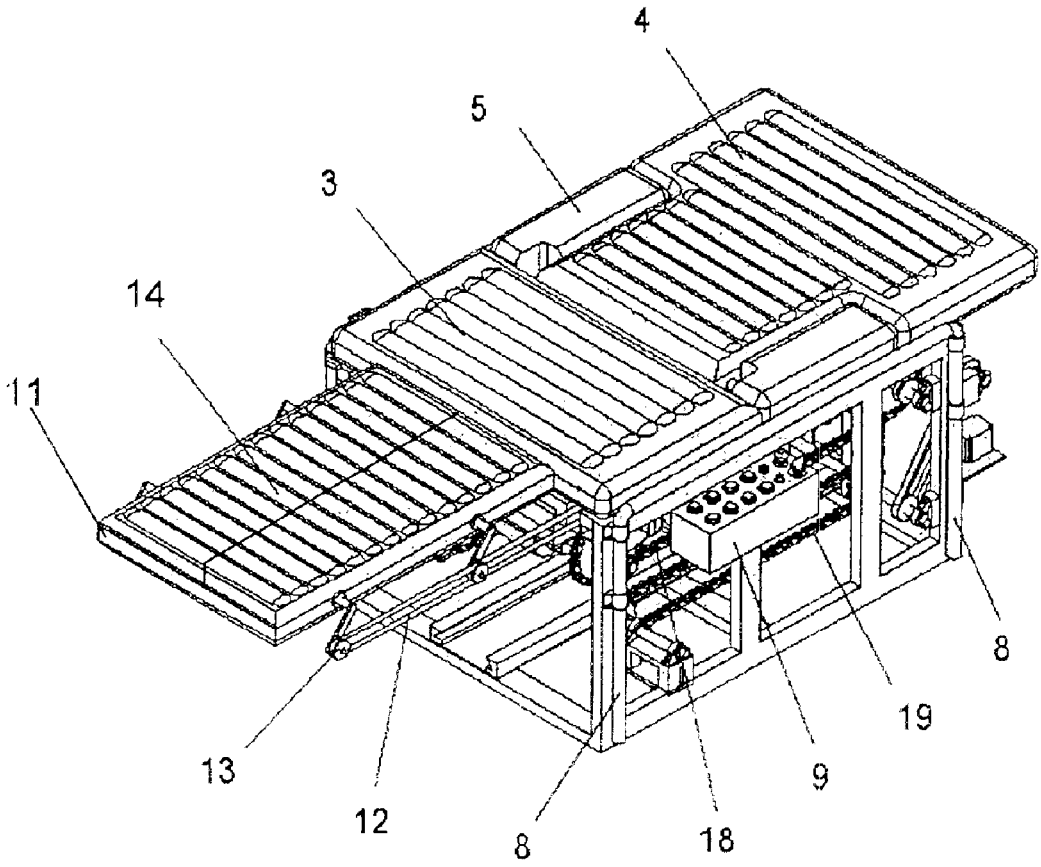
FIG. 2 shows an isometric view of the chair-bed extended the parts to become a patient bed.
Figure 3:
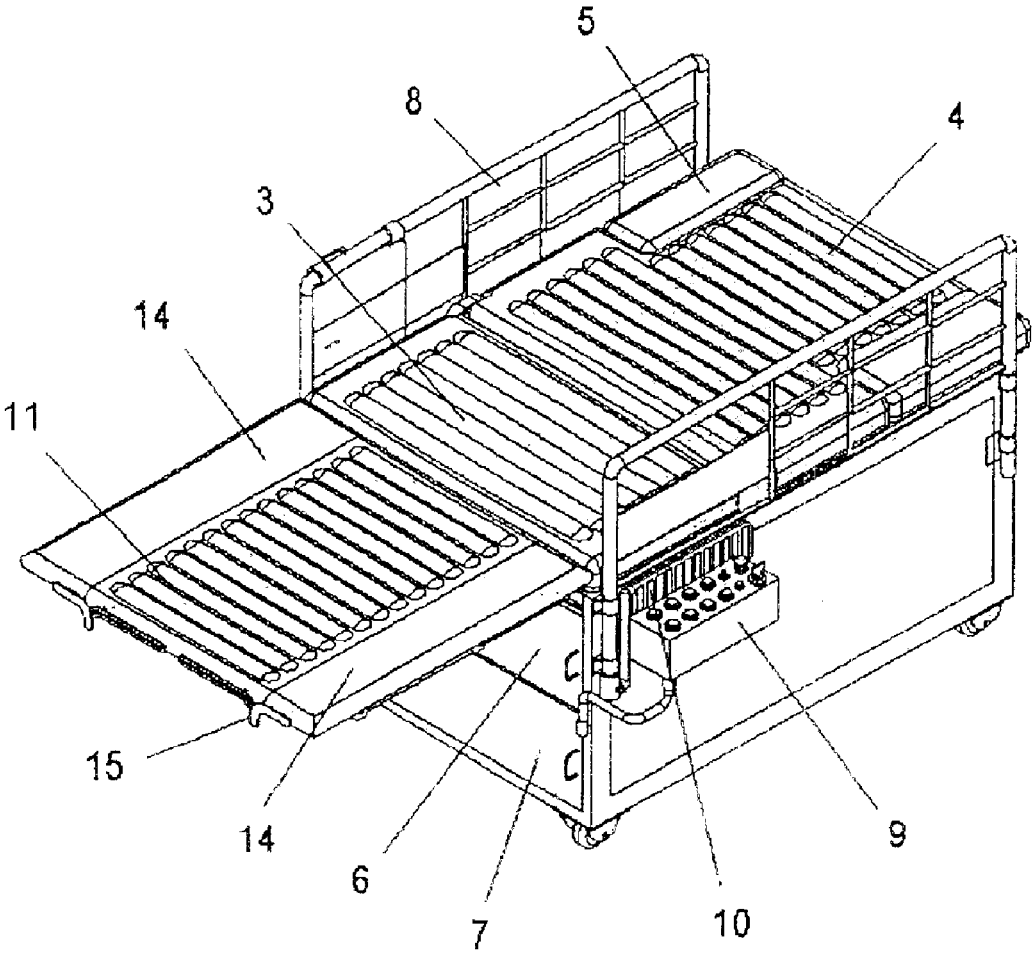
FIG. 3 shows an isometric view of the chair-bed in full arrangement as a patient bed with rack guards pulled up.
Figure 5:
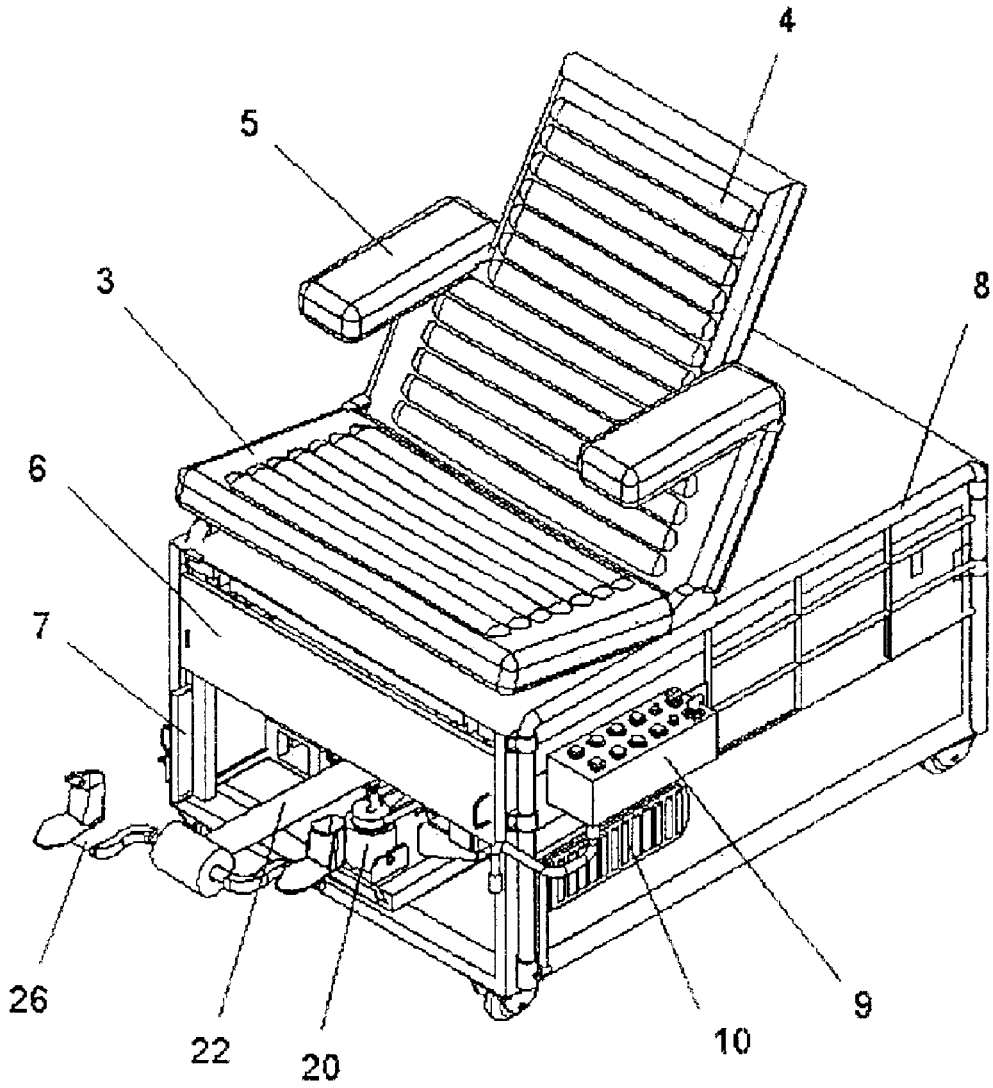
FIG. 5 shows the chair-bed when arranged to be a physical therapy chair.
Figure 6:
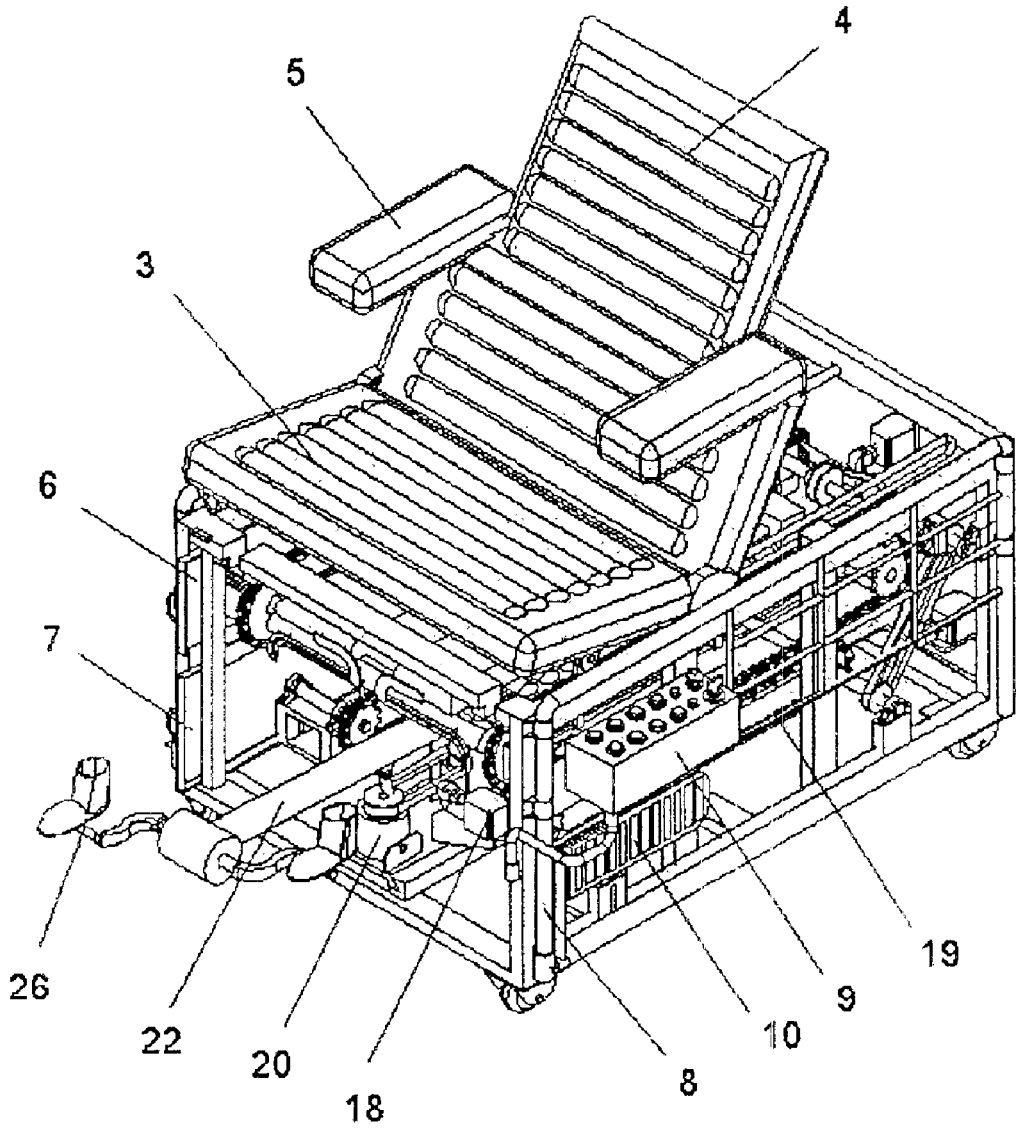
FIG. 6 is the chair-bed arranged as a physical therapy chair with its seat lifted slightly up and the upper flanking portions of the backrest positioned as armrests.
Figure 7:
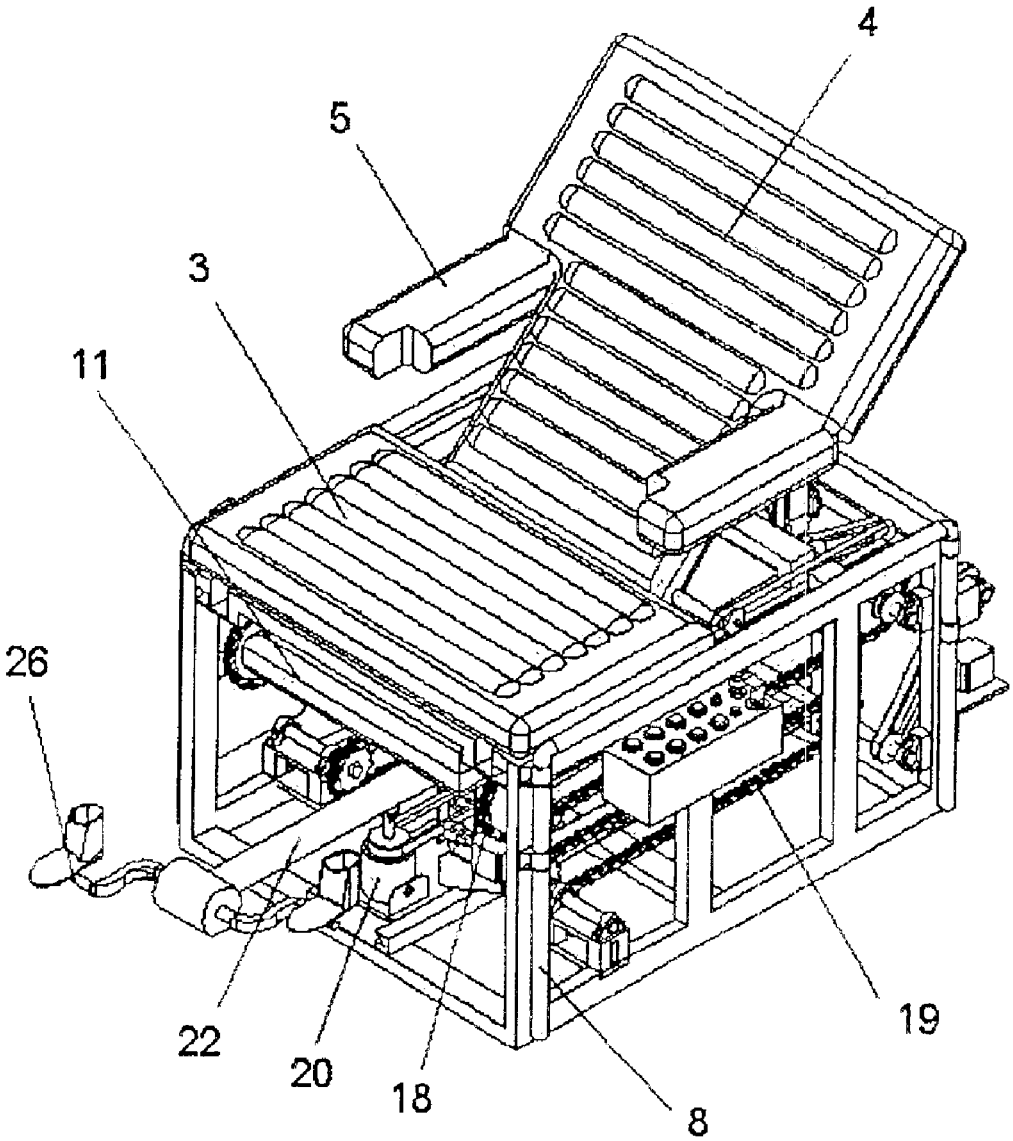
FIG. 7 is the chair-bed where the lower flanking portions of the backrest positioned as armrests of the physical therapy chair.
Figure 9:
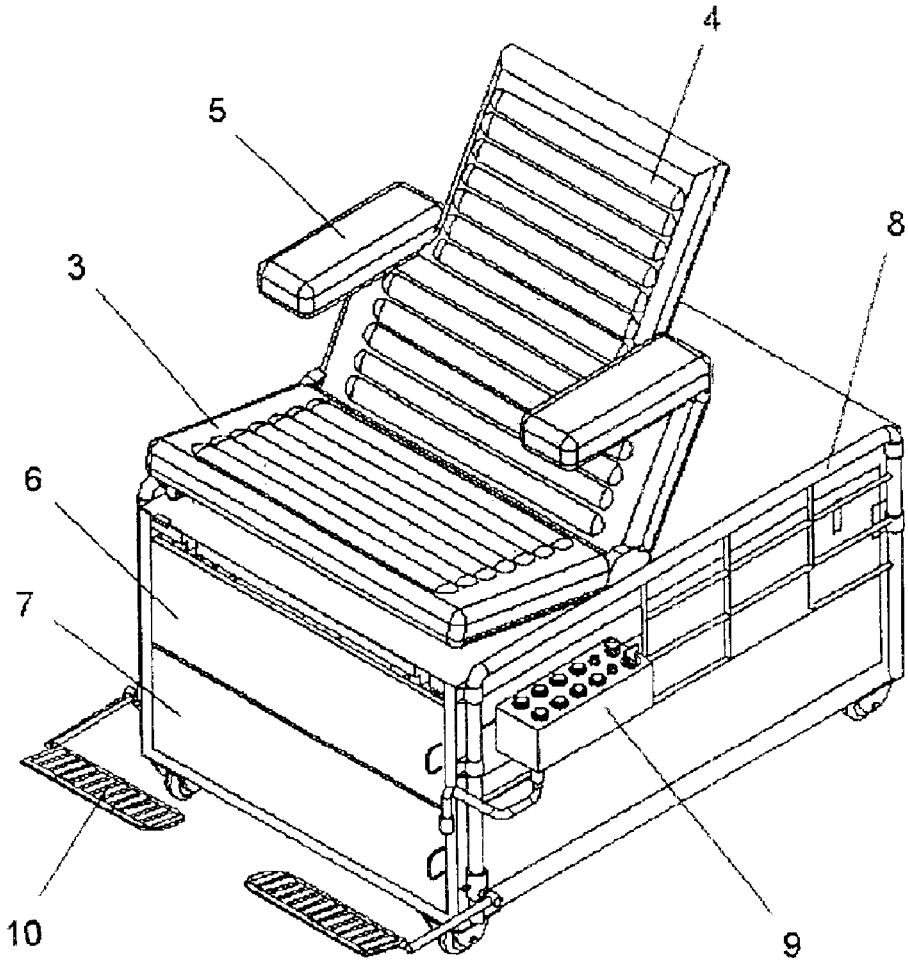
FIG. 9 shows the chair-bed adjusted for sitting with footrests put in place.

FIG. 1 shows the present invention physical therapy chair-bed for paralytic patient in a wrapped-up position. The physical therapy chair-bed consists of three parts, the first, the second and the third parts where the first part and the second part are mounted on top of case 1 and all the other components are kept inside case 1. There mounted under case 1 at each comer a wheel 2 to assist moving where wheel-lock may be installed to fix the case in place when in use. All three parts are arranged as a patient-bed, FIGS. 2 and 3, or as a physical therapy chair, FIGS. 5–7. On top of case 1 are the first part 4 and the second part 3 which have two sets of mattress mounted on. Part 3 Alternatively Functions as a seat while part 4 Alternatively Function as backrest. Backrest 4 is pivotally adjusted to any angle from horizontal to any upright position to support patients back and head, preferably not greater than 90 degree. The surface of the two mattresses can be grooved to improve air circulation during use. Flanking backrest 4 are two armrests 5 which are arranged for arm resting when backrest 4 is held up. There are two doors at the front of case 1, the upper door 6 and the lower door 7. These doors are opened sidewise and pushed to be kept inside case 1, FIGS. 5 and 6. As shown in FIGS. 2 and 3, control box 9 at the side of case 1 is used to control the electrical system of the chair-bed. The components of the physical chair-bed are either controlled manually or automatic electronically or by any other kind of control where appropriate, and especially the remote control system may also be applied. The chair-bed is equipped with a foot-leg exercise set which is moved when in use out from case 1, FIG. 4. There are footrests 10 which are kept along the case-side when not in use, FIGS. 4 and 5 or laid down for foot-resting as shown in FIG. 9.

FIGS. 2 and 3 illustrate the chair-bed mechanism in a position to be used as hospital bed. Upon turning on a control switch on the control box 9, a motor 17 at the back of case 1, FIG. 8, drives an axle 18 to move the third part 11 out from underneath seat 3 along the extending supporting rail 12 with hub 13 and lift the third part 11 to connect at the same level to seat 3 as shown in FIG. 2. There also mounted on top of part 11 with two mattresses 14. The two mattresses 14 on top of part 11 are alternative swung out and connected to part 11 on each side and held flat to the same level as part 11 by flap 15 as shown in FIG. 3. Two rack guards 8 flanking both sides of the chair-bed as shown in FIGS. 1–2 are pulled up and locked in place as in FIG. 3 to help the patient not to fall off from the bed.

Figure 4:
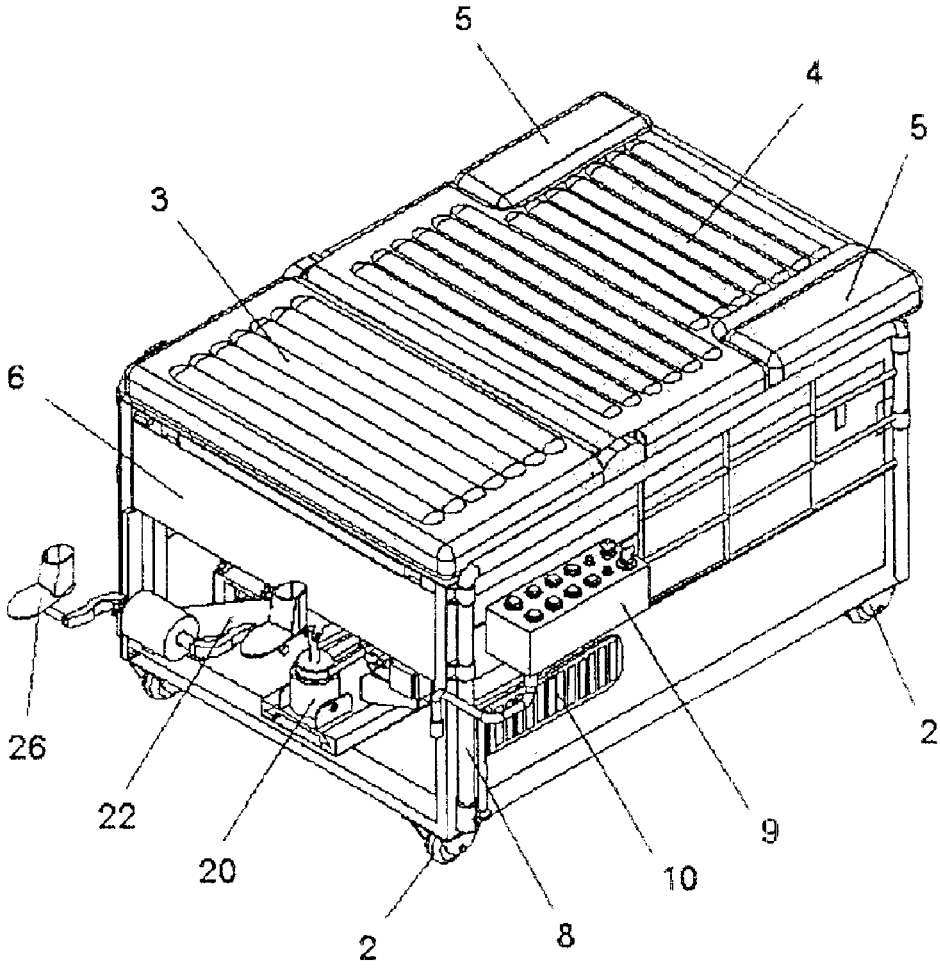
FIG. 4 shows a foot-leg exercise set with footwear on each pedal extended out from a case under the bed.
Figure 8:
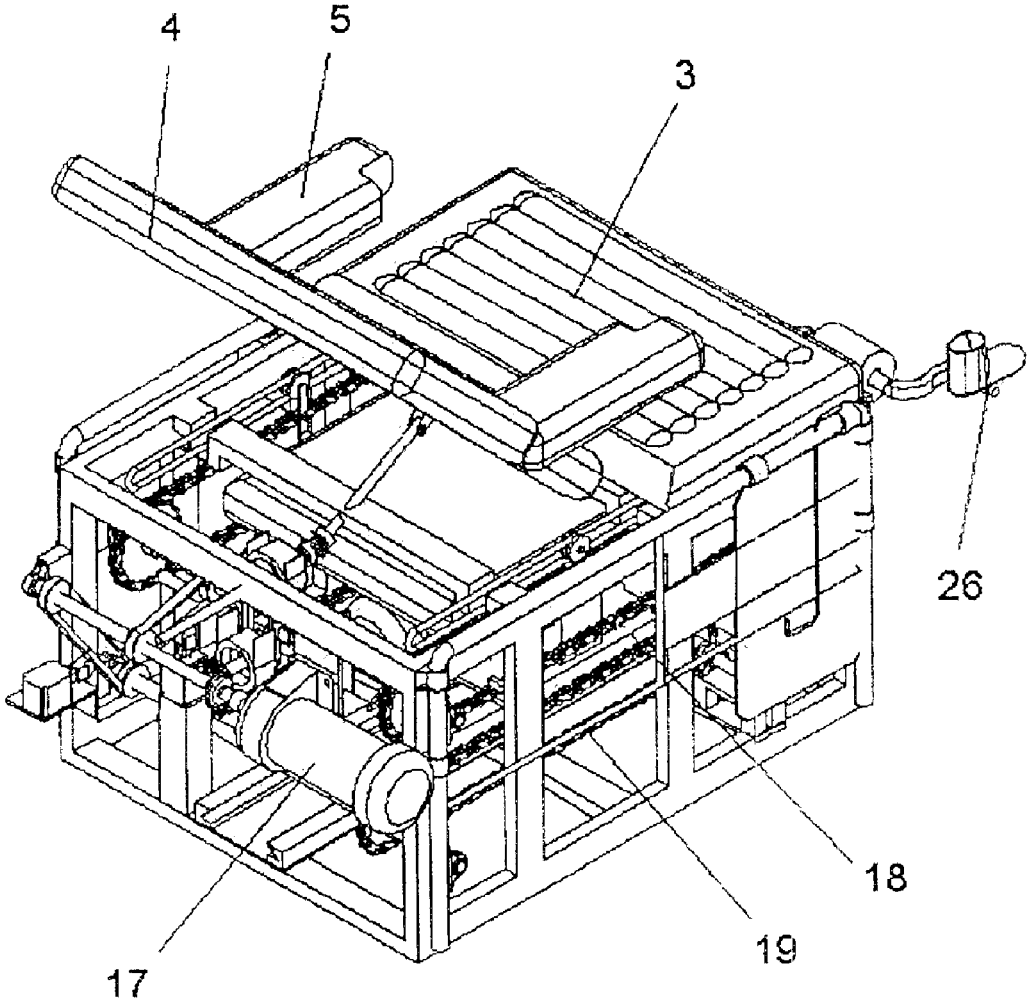
FIG. 8 shows the back view of the physical therapy chair.

FIG. 4 shows the chair-bed to be used as a physical therapy chair where part 11 is pushed to be kept inside case 1. When motor 17 as shown in FIG. 8 is turned on, it drives through an electrical transmission axle 19 to move a physical therapy set out from case 1, FIGS. 6–8. The physical therapy set which is a foot-leg exercise set is equipped with boots or any kinds of footwear for patient to wear where the level of the set is adjustable by mechanical system or automatically by electrical system to fit for each individual before use. Upon operation, another motor 16 as shown in FIG. 10, drives to have the patient's legs and feet exercise as if he is riding a bicycle where through electrical gears and cogwheels the speed of riding is possible adjusted and the pedaling can be either forward or backward.

FIGS. 5–8 shows the chair-bed when being adjusted as a physical therapy chair. The backrest 4 is pivotally moved up to a desirable angle and functions as a backrest while seat 3 is also adjusted to slightly slope up to have the patient sit and be kept on the seat comfortably during the exercise. The mechanical and electrical systems as in FIG. 8 level the backrest and the seat to appropriate angles to prevent the patient from falling out of the chair while he is exercising. FIG. 9 shows the chair-bed when not in use for exercising where the patient can sit on with the footrests 10 put in place. In addition, using conventional mechanisms of electrical, mechanical and electronics the armrest 5 is designed to pivotally move sidewise automatically to and fro, preferably about 90 degree that the patient can have the movement at his elbows and shoulders to prevent stiff-joint.

Figure 10:
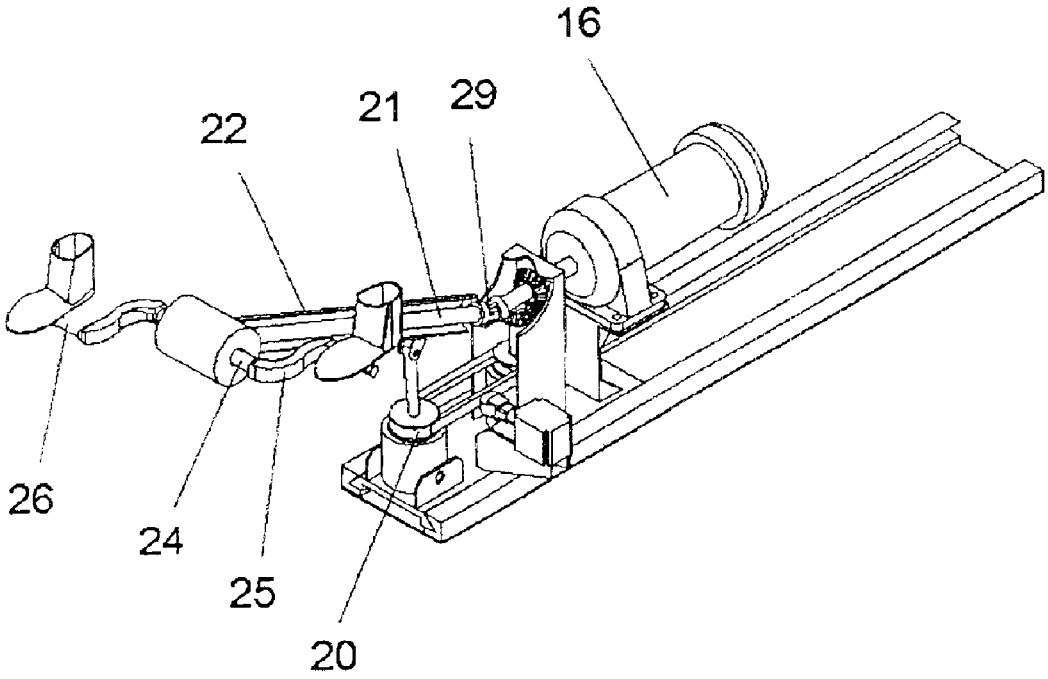
FIG. 10 shows the foot-leg exercise set.
Figure 11:
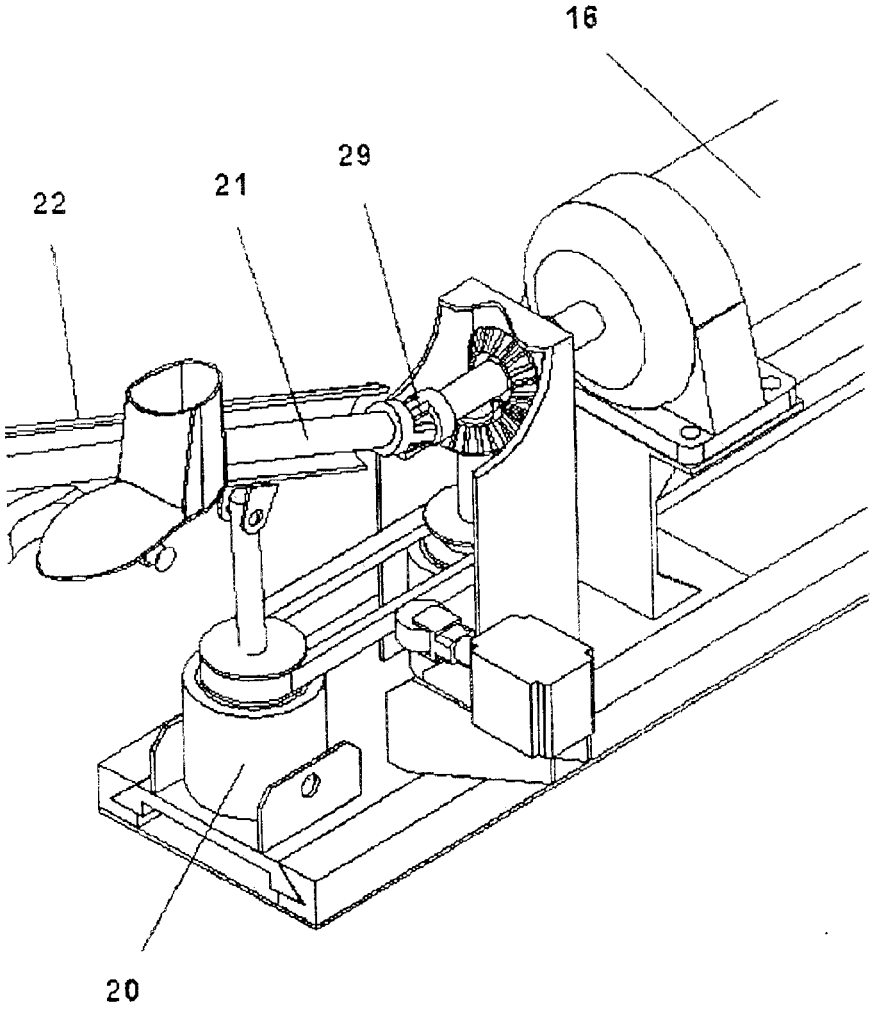
FIG. 11 is the enlarged view showing the connection between a motor and a shaft that drives the pedals to move.

FIGS. 10 and FIG. 11 illustrate the foot-leg exercise set. The motor set for driving the pedals consisting of motor 16, the core set and the pedals with boots or shoes. Shaft 21 inside casing 22 is connected with joint 29 connecting to motor 16 where casing 22 is leveled upward or downward through mechanism 20.

Figure 12:
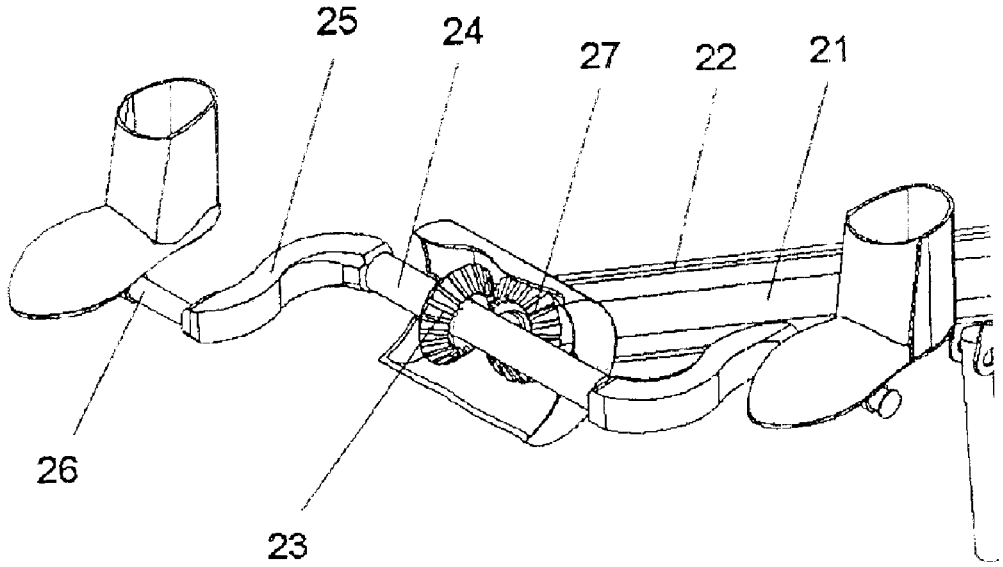
FIG. 12 shows the connection between the bevel gears and shafts that drives the pedals to move.
Figure 13:
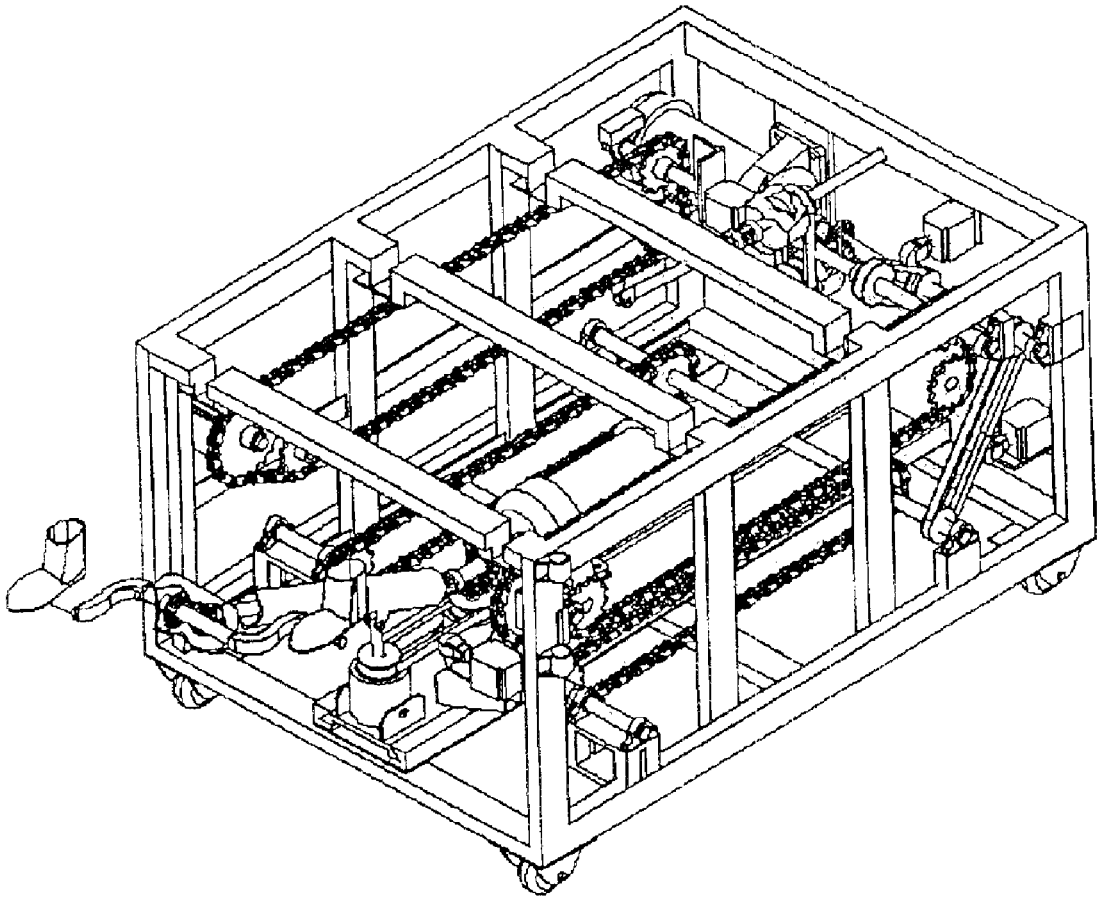
FIG. 13 shows arrangement of all the components in the case.
Figure 14B:
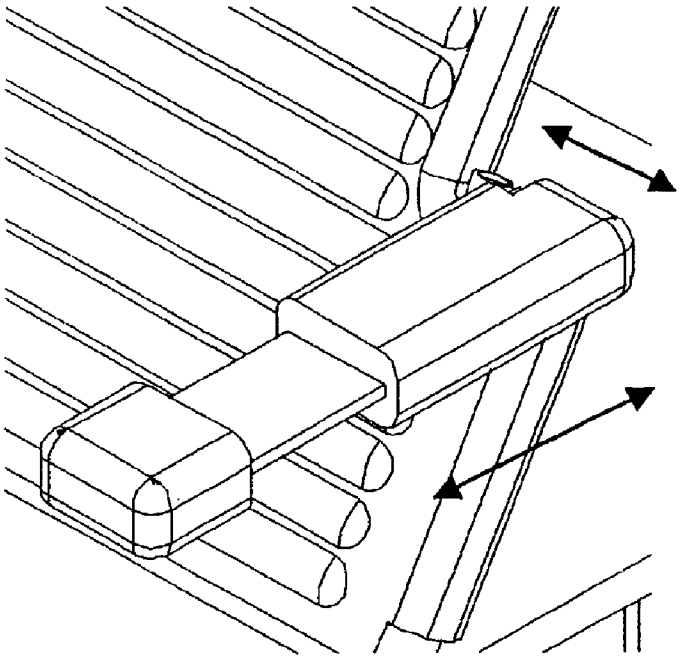
FIG. 14B shows how armrest extends its length.
Figure 14A:
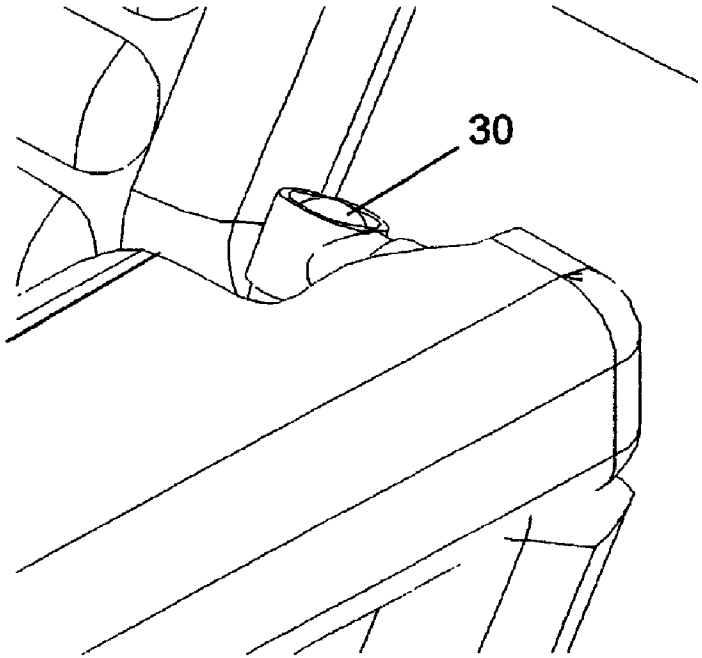
FIG. 14A shows a pulley nut allowing a flanking part of backrest to be moved pivotally and form an armrest.
Figure 14D:
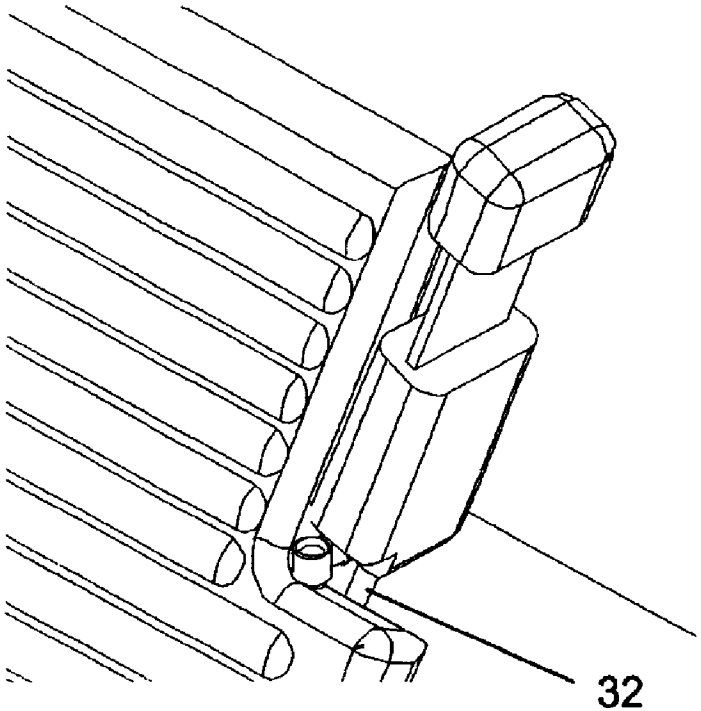
FIG. 14D shows how armrest moves up to exercise elbow and forearm.
Figure 14C:
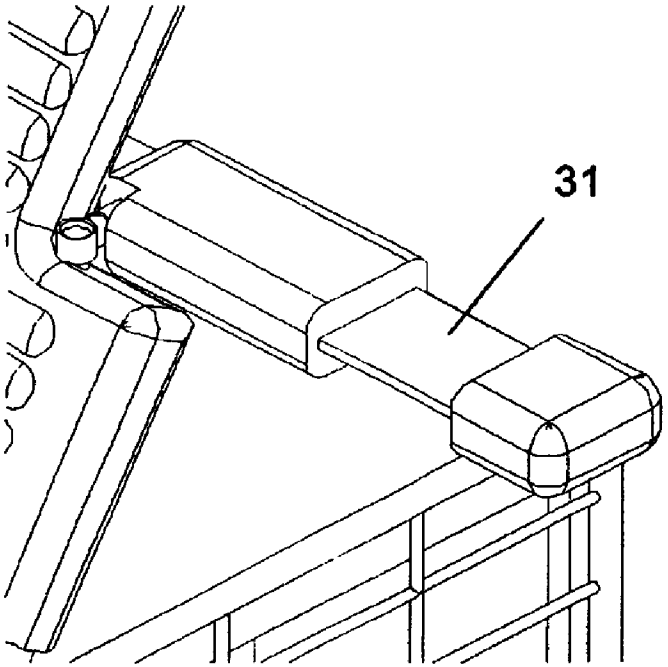
FIG. 14C shows how armrest moves pivotally sidewise to allow movement of joints at elbow and shoulder.

FIGS. 10–12 show how power transmission drives the pedals to rotate. Shaft 21 is connected to a bevel gear 27 at its front end. Motor 16 drives shaft 21 to rotate through a bevel gear and joint 19 which in turn rotates bevel gear 27. Rotation of bevel gear 27 then drives the bevel gear 23 which in turn will rotate shaft 24. Rotating shaft 24 then rotates arms 25 and pedals 26 in a bicycling manner. On each pedal, shoe or any kinds of footwear is mounted on to be worn by the seat occupant. Mechanism 20 is used to level the bicycling set up and down to fit for each individual. The speed of bicycling is adjusted mechanically or electrically. FIG. 13 shows the arrangement of all the components in the case.

The flanking part of backrest moves pivotally down to form an armrest, FIGS. 14A–D, where the armrest can pivotally move sidewise around a pulley nut 30 or extends its length through a plate 31, or alternatively is folded up through axle 32 to allow movement of joints at elbow and shoulder. Any mechanisms may be applied to fasten the seat occupant's arm comfortably to the armrest.

Practically, mechanical or electrical systems may be applied where appropriate and instead of bevel gears, belts or chains as pulleys or gears may also be used.

It will be understood that changes may be made within the scope of this invention by one of ordinary skill in the art without departing from the spirit thereof. It is accordingly intended that all matter contained in the above description be interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

I claim:

1. A physical therapy chair-bed device designed and configured for a paralytic patient to exercise and maintain muscular tone and prevent stiff-joints, said device comprising:

A case having a first and second part; said first and second part comprising a upper and lower door positioned at a front end of said case;

A bed having a first end and a second end associated with said case;

Said bed having three parts, a first part, a second part and a third part, each of said three parts being aligned horizontally at the same height, said first part and second part being mounted atop said case and said third part being slidably receivable in said case;

Said first part of said bed having a plurality of mattresses mounted thereon, said first part further comprising a first and second flanking portions including a right side portion and a left side portion, said flanking portions form armrests; said first part being alternatively pivotally adjustable, mechanically or electrically, at an outer end to an angle to form a backrest of said device, said first part having a first and second position, whereby said first position of said first part includes lying said first part flat atop said case where said first part is configured as said patient therapy bed, and said second position of said first part is vertically positioned upright and arranged as a backrest of said patient therapy chair;

Said second part forming a middle part of said bed and having a plurality of mattresses mounted thereon, said second part being alternatively raised, incrementally, and pivotally about a central point of said first part and arranged as a seat of said patient therapy chair or a middle of said patient therapy bed;

Said third part of said bed having first and second flanking portions, said first and second flanking portions of said third part being alternatively folded and arranged atop a middle portion of said third part, the folded third part is alternatively inserted underneath said first and second part of said case;

A foot-leg exercise set consisting of a pair of rotating pedals, said pedals having attached footwear designed and configured to be worn by a user whereby the user places a foot in each said footwear of said pedals and rotates the feet in a cycling manner, said set is alternatively placed in said case and arranged underneath said first and second parts;

A motor secured at a rear section of said case, wherein said pedals are driven by said motor to move the users feet in a cycling position and whereof the speed of said pedals is preset and the height of said pedals are adjusted for each user; and A plurality of footrests;

Restraining means to prevent the arms from falling off said armrests;

A remote control system for controlling a control box;

A plurality of wheels secured below said case at a corner for moving said case along a ground surface;

A control switch;

At least one wheel-lock for preventing the case from rolling when in use.

* * * * *